US011183110B2

(12) United States Patent
Pyo et al.

(10) Patent No.: US 11,183,110 B2
(45) Date of Patent: Nov. 23, 2021

(54) LUMINANCE CONTROL UNIT AND DISPLAY DEVICE INCLUDING THE SAME

(71) Applicant: Samsung Display Co., Ltd., Yongin-si (KR)

(72) Inventors: Si Beak Pyo, Yongin-si (KR); Sung Kook Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/182,018

(22) Filed: Feb. 22, 2021

(65) Prior Publication Data

US 2021/0174738 A1 Jun. 10, 2021

Related U.S. Application Data

(63) Continuation of application No. 16/821,658, filed on Mar. 17, 2020, now Pat. No. 10,930,208.

(30) Foreign Application Priority Data

Mar. 20, 2019 (KR) ..... 10-2019-0032014

(51) Int. Cl.
*G09G 3/3208* (2016.01)

(52) U.S. Cl.
CPC ... *G09G 3/3208* (2013.01); *G09G 2320/0626* (2013.01); *G09G 2320/0673* (2013.01); *G09G 2330/021* (2013.01); *G09G 2360/144* (2013.01)

(58) Field of Classification Search
CPC ... G09G 2320/0276; G09G 2320/0673; G09G 2360/16; G09G 2320/0626; G09G 2320/0233; G09G 3/3406; G09G 2320/0271
See application file for complete search history.

(56) References Cited

U.S. PATENT DOCUMENTS

| | | | | |
|---|---|---|---|---|
| 8,519,921 | B2 | 8/2013 | Lee et al. | |
| 9,542,887 | B2 | 1/2017 | Pyo | |
| 2010/0117940 | A1* | 5/2010 | Wu | G09G 3/3611 345/84 |

(Continued)

FOREIGN PATENT DOCUMENTS

| | | | |
|---|---|---|---|
| KR | 10-0884791 | B1 | 2/2009 |
| KR | 10-2015-0114020 | A | 10/2015 |
| KR | 10-2017-0066771 | A | 6/2017 |

*Primary Examiner* — Gerald Johnson
(74) *Attorney, Agent, or Firm* — Lewis Roca Rothgerber Christie LLP

(57) ABSTRACT

A luminance control unit includes: a driving power voltage setting unit configured to determine a driving power voltage to be provided to a display panel, the driving power voltage corresponding to a target brightness, based on a plurality of driving power voltages respectively corresponding to a plurality of reference brightnesses of the display panel; and a gamma voltage setting unit configured to determine a target luminance corresponding to the target brightness, based on a plurality of target luminances respectively corresponding to the plurality of reference brightnesses, and to set gamma voltages for implementing the target luminance, wherein the driving power voltage and the gamma voltages are differently set with respect to the same reference brightness according to an ambient illumination intensity of the display panel.

16 Claims, 6 Drawing Sheets

(56) References Cited

U.S. PATENT DOCUMENTS

| | | | | |
|---|---|---|---|---|
| 2013/0135272 | A1* | 5/2013 | Park | G09G 3/3233 345/211 |
| 2013/0147864 | A1 | 6/2013 | Kim et al. | |
| 2014/0176516 | A1* | 6/2014 | Kim | G09G 3/3233 345/204 |
| 2014/0320552 | A1 | 10/2014 | Seo et al. | |
| 2016/0049113 | A1 | 2/2016 | Park | |
| 2016/0329019 | A1 | 11/2016 | An | |
| 2017/0011682 | A1 | 1/2017 | Pyo et al. | |
| 2017/0076695 | A1 | 3/2017 | Hwang et al. | |
| 2017/0186375 | A1 | 6/2017 | Jung et al. | |
| 2018/0059470 | A1* | 3/2018 | Nam | G09G 3/3677 |
| 2020/0126499 | A1 | 4/2020 | Huang et al. | |

* cited by examiner

FIG. 7

| DBV | TL (nit) | DBV Code (hex) | ELVSS (V) | offsetTH |
|---|---|---|---|---|
| DBV0 | 1200 | 7FF | −5.0 | – |
| DBV1 | 650 | 60D | −3.1 | – |
| DBV2 | 300 | 442 | −1.8 | – |
| DBV3 | 100 | 296 | −1.5 | – |
| DBV4 | 60 | 20C | −1.5 | – |
| DBV5 | 30 | 17F | −1.5 | – |
| DBV6 | 15 | 117 | −1.5 | – |
| DBV7 | 10 | 0E8 | −1.5 | – |
| DBV8 | 7 | 0C6 | −1.5 | – |
| DBV9 | 4 | 099 | −1.5 | – |
| DBV10 | 2 | 070 | −1.5 | – |

FIG. 8

| DBV | TL (nit) | DBV Code (hex) | ELVSS (V) | offsetTH |
|---|---|---|---|---|
| DBVL | 1000 | 759 | −3.1 | 35% |
| DBV1 | 650 | 60D | | – |
| DBV2 | 300 | 442 | −1.8 | – |
| DBV3 | 100 | 296 | −1.5 | – |
| DBV4 | 60 | 20C | −1.5 | – |
| DBV5 | 30 | 17F | −1.5 | – |
| DBV6 | 15 | 117 | −1.5 | – |
| DBV7 | 10 | 0E8 | −1.5 | – |
| DBV8 | 7 | 0C6 | −1.5 | – |
| DBV9 | 4 | 099 | −1.5 | – |
| DBV10 | 2 | 070 | −1.5 | – |

LUMINANCE CONTROL UNIT AND DISPLAY DEVICE INCLUDING THE SAME

CROSS-REFERENCE TO RELATED APPLICATIONS

This application is a continuation of U.S. patent application Ser. No. 16/821,658, filed Mar. 17, 2020, which claims priority to and the benefit of Korean Patent Application No. 10-2019-0032014, filed Mar. 20, 2019, the entire content of both of which is incorporated herein by reference.

BACKGROUND

1. Field

Aspects of some example embodiments of the present disclosure generally relate to a luminance control unit and a display device including the same.

2. Description of the Related Art

A display device may display an image, based on input image data. The display device may modulate luminance of input image data according to an Average Pixel Level (APL) of the input image data, so that power consumption of the display device can be reduced. This may be referred to as an Auto Current Limit (ACL) function.

A display device may also adjust a low-potential driving power voltage according to an APL of input image data, so that power consumption of the display device can be reduced. This may be referred to as a Content Adaptive Power Saving (CAPS) function.

In the ACL function, luminance of input image data is collectively modulated according to an APL of the input image data, and hence a requirement of a user who desires high-luminance emission can be satisfied even in a high APL image. In the CAPS function, a low-potential driving power voltage may be adjusted, and therefore, a weak bright spot may occur.

The above information disclosed in this Background section is only for enhancement of understanding of the background and therefore it may contain information that does not constitute prior art.

SUMMARY

Some example embodiments provide a luminance control unit configured to determine a driving power voltage according to an ambient illumination intensity and limit a target brightness according to the determined driving power voltage, and a display device including the luminance control unit.

Some example embodiments also provide a luminance control unit configured to adaptively perform luminance correction according to an ambient illumination intensity when an Average Pixel Level (APL) is greater than a threshold value, so that power consumption can be reduced without image quality degradation, and a display device including the luminance control unit.

According to some example embodiments of the present disclosure, a luminance control unit includes: a driving power voltage setting unit configured to determine a driving power voltage to be provided to a display panel, corresponding to a target brightness, based on a plurality of driving power voltages respectively corresponding to a plurality of reference brightnesses of the display panel; and a gamma voltage setting unit configured to determine a target luminance corresponding to the target brightness, based on a plurality of target luminances respectively corresponding to the plurality of reference brightnesses, and set gamma voltages for implementing the target luminance, wherein the driving power voltage and the gamma voltages are differently set with respect to the same reference brightness according to an ambient illumination intensity of the display panel.

According to some example embodiments, when the ambient illumination intensity is less than an illumination intensity threshold value, a maximum value of the reference brightnesses may be set smaller than a maximum reference brightness of the display panel.

According to some example embodiments, when the ambient illumination intensity is less than the illumination intensity threshold value, the driving power voltage setting unit may equally set the driving power voltages as a threshold driving power voltage, corresponding to reference brightnesses greater than a first threshold brightness.

According to some example embodiments, the first threshold brightness may be a minimum value of reference brightnesses with which an abnormal output is not viewed on the display panel when the display panel is driven by the threshold driving power voltage.

According to some example embodiments, the luminance control unit may further include a luminance modulator configured to correct the gamma voltages, when an Average Pixel Level (APL) of input image data is greater than or equal to an APL threshold value.

According to some example embodiments, the luminance modulator may determine a correction luminance with respect to the target luminance, based on the target brightness, and correct the gamma voltages to implement the correction luminance.

According to some example embodiments, when the ambient illumination intensity is less than the illumination intensity threshold value, the luminance modulator may equally set the correction luminance, corresponding to reference brightnesses greater than the first threshold brightness.

According to some example embodiments, when the ambient illumination intensity is less than the illumination intensity threshold value, the luminance modulator may set the correction luminance such that the difference between the correction luminance and the target luminance with respect to the maximum value of the reference brightnesses corresponds to a threshold correction offset.

According to some example embodiments of the present disclosure, a display device includes: a display panel including a plurality of pixels; a luminance control unit configured to determine a driving power voltage, based on a target brightness of the display panel, and set gamma voltages for implementing a target luminance corresponding to the target brightness; a display panel driver configured to drive the display panel, based on the gamma voltages; and a power provider configured to provide the determined driving power voltage to the display panel, wherein the driving power voltage and the gamma voltages are differently set with respect to the same reference brightness according to an ambient illumination intensity of the display panel.

According to some example embodiments, the luminance control unit may include: a driving power voltage setting unit configured to include a plurality of driving power voltages respectively corresponding to a plurality of reference brightnesses, and determine the driving power voltage to be provided to the display panel, based on the target brightness; and a gamma voltage setting unit configured to include a plurality of target luminances respectively corresponding to the plurality of reference brightnesses, and set the target luminance and the gamma voltages for implementing the target luminance, based on the target brightness.

According to some example embodiments, when the ambient illumination intensity is less than an illumination intensity threshold value, a maximum value of the reference brightnesses may be set smaller than a maximum reference brightness of the display panel.

According to some example embodiments, when the ambient illumination intensity is less than the illumination intensity threshold value, the driving power voltage setting unit may equally set the driving power voltages as a threshold driving power voltage, corresponding to reference brightnesses greater than a first threshold brightness.

According to some example embodiments, the luminance control unit may further include a luminance modulator configured to correct the gamma voltages, when an Average Pixel Level (APL) of input image data is greater than or equal to an APL threshold value.

According to some example embodiments, the luminance modulator may determine a correction luminance with respect to the target luminance, based on the target brightness, and correct the gamma voltages to implement the correction luminance.

According to some example embodiments, when the ambient illumination intensity is less than the illumination intensity threshold value, the luminance modulator may equally set the correction luminance, corresponding to reference brightnesses greater than the first threshold brightness.

According to some example embodiments, when the ambient illumination intensity is less than the illumination intensity threshold value, the luminance modulator may set the correction luminance such that the difference between the correction luminance and the target luminance with respect to the maximum value of the reference brightnesses corresponds to a threshold correction offset.

BRIEF DESCRIPTION OF THE DRAWINGS

Aspects of some example embodiments will now be described more fully hereinafter with reference to the accompanying drawings; however, they may be embodied in different forms and should not be construed as limited to the example embodiments set forth herein. Rather, these example embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 7 is a diagram illustrating an example in which reference brightnesses, target luminances, and low-potential driving power voltages are set in a high illumination intensity environment.

FIG. 8 is a diagram illustrating an example in which reference brightnesses, target luminances, and low-potential driving power voltages are set in a low illumination intensity environment.

DETAILED DESCRIPTION

Figure 1:
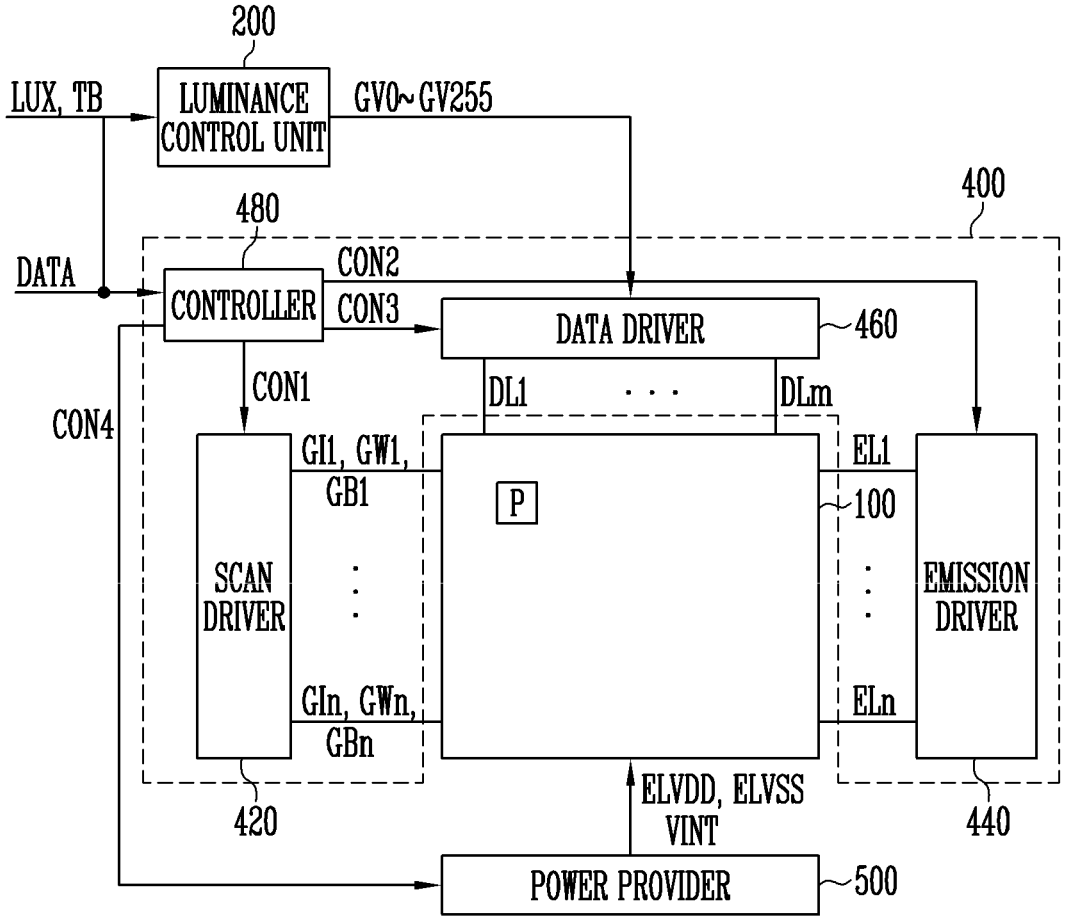
FIG. 1 is a block diagram illustrating a display device in according to some example embodiments of the present disclosure.

Hereinafter, aspects of some example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be more thorough and more complete, and will more fully convey the aspects and features of the present invention to those skilled in the art. Accordingly, processes, elements, and techniques that are not necessary to those having ordinary skill in the art for a complete understanding of the aspects and features of the present invention may not be described or shown in the figures. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to"

another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." In addition, the use of alternative language, such as "or," when describing embodiments of the present invention, refers to "one or more embodiments of the present invention" for each corresponding item listed. As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to some example embodiments of the present disclosure.

Referring to FIG. 1, the display device may include a display panel 100, a luminance control unit (or luminance controller, or luminance control circuit) 200, a display panel driver 400, and a power provider (or power source or power supply) 500.

The display panel 100 may include a plurality of pixels P, and display an image. The display panel 100 may be coupled to a scan driver 420 through a plurality of scan lines, be coupled to an emission driver 440 through a plurality of emission control lines EL1 to ELn, and be coupled to a data driver 460 through a plurality of data lines DL1 to DLm. The plurality of pixels P are located at intersection points of the plurality of scan lines, the plurality of emission control lines EL1 to ELn, and the plurality of data lines DL1 to DLm, and hence the display panel 100 may include n*m pixels P, where "n" and "m" are natural numbers greater than zero.

According to some example embodiments, each of the pixels P may include an organic light emitting diode. The organic light emitting diode emits light with a luminance corresponding to a data voltage applied from the data driver 460 in response to an emission control signal transferred through a corresponding emission control line among the emission control lines EL1 to ELn. According to some example embodiments, each of the pixels P may be provided with a corresponding scan signal among scan signals GW1 to GWn, a corresponding initialization signal GI1 to Gin, and a corresponding bypass signal GB1 to GBn from the scan driver 420. The initialization signal may correspond to a previous scan signal of the scan signal, and the bypass signal may correspond to a next scan signal of the scan signal. The initialization signal may initialize a gate voltage of a driving transistor included in the pixel P. The bypass signal may initialize an anode voltage of the organic light emitting diode included in the pixel P so as to prevent excitation of black luminance.

A configuration of the pixel P included in the display panel 100 will be described in more detail with reference to FIG. 2.

The luminance control unit 200 may control the luminance of an image that the display panel 100 displays by using luminance control. For example, according to some example embodiments of the present disclosure, the luminance control unit 200 may perform different luminance controls according to an ambient illumination intensity LUX.

According to some example embodiments, the luminance control unit 200 may include a driving power voltage determiner configured to determine a low-power driving power voltage ELVSS, corresponding to an ambient illumination intensity LUX and a target brightness TB, a gamma voltage setting unit (or gamma voltage setter, or gamma voltage setting circuit) configured to determine a target luminance with respect to a reference brightness, corresponding to the ambient illumination intensity LUX, and set gamma voltages, based on the target luminance, and a luminance modulator configured to correct gamma voltages according to an Average Pixel Level (APL) of input image data DATA.

According to some example embodiments, the luminance control unit 200 may be included in a controller 480 or be included in the power provider 500. A luminance control method of the luminance control unit 200 will be described in more detail below with reference to FIGS. 3 to 8.

The display panel driver 400 may drive the display panel 100, based on input image data DATA and gamma voltages GV0 to GV255. According to some example embodiments, the display panel driver 400 may include the scan driver 420, the emission driver 440, the data driver 460, and the controller 480.

The scan driver 420 may provide a scan signal to the display panel 100 through a plurality of scan lines. According to some example embodiments, the scan driver 420 may provide the display panel 100 with the scan signals GW1 to GWn, the initialization signals GI1 to Gin, and the bypass signals GB1 to GBn through the scan lines. According to some example embodiments, each of the scan lines may be coupled to pixels P located on each pixel of the display panel 100.

The emission driver 440 may provide an emission control signal to the display panel 100 through the plurality of emission control lines EU to ELn. According to some example embodiments, each of the emission control lines EL1 to ELn may be coupled to pixels P located on each pixel row of the display panel 100.

The data driver 460 may a data voltage based on selected gamma voltages GV0 to GV255 to the display panel 100 through the plurality of data lines DL1 to DLm. Each of the data lines DL1 to DLm may be coupled to pixels P located on each pixel row of the display panel 100.

The controller 480 may control the scan driver 420, the emission driver 440, the data driver 460, and the power provider 500, based on first to fourth control signals CON1 to CON4. According to some example embodiments, the controller 480 may receive image data DATA and an input control signal from an image source such as an external graphic device.

The power provider 500 may provide a high-potential driving power voltage ELVDD and a low-potential driving power voltage ELVSS to the display panel 100 under the control of the luminance control unit 200. According to some example embodiments, the power provider 500 may be included in the luminance control unit 200. According to some example embodiments, the power provider 500 may further provide an initialization power voltage VINT to the display panel 100. According to some example embodiments, the initialization power voltage VINT may be set based on the low-potential driving power voltage ELVSS, but the present disclosure is not limited thereto.

Figure 2:
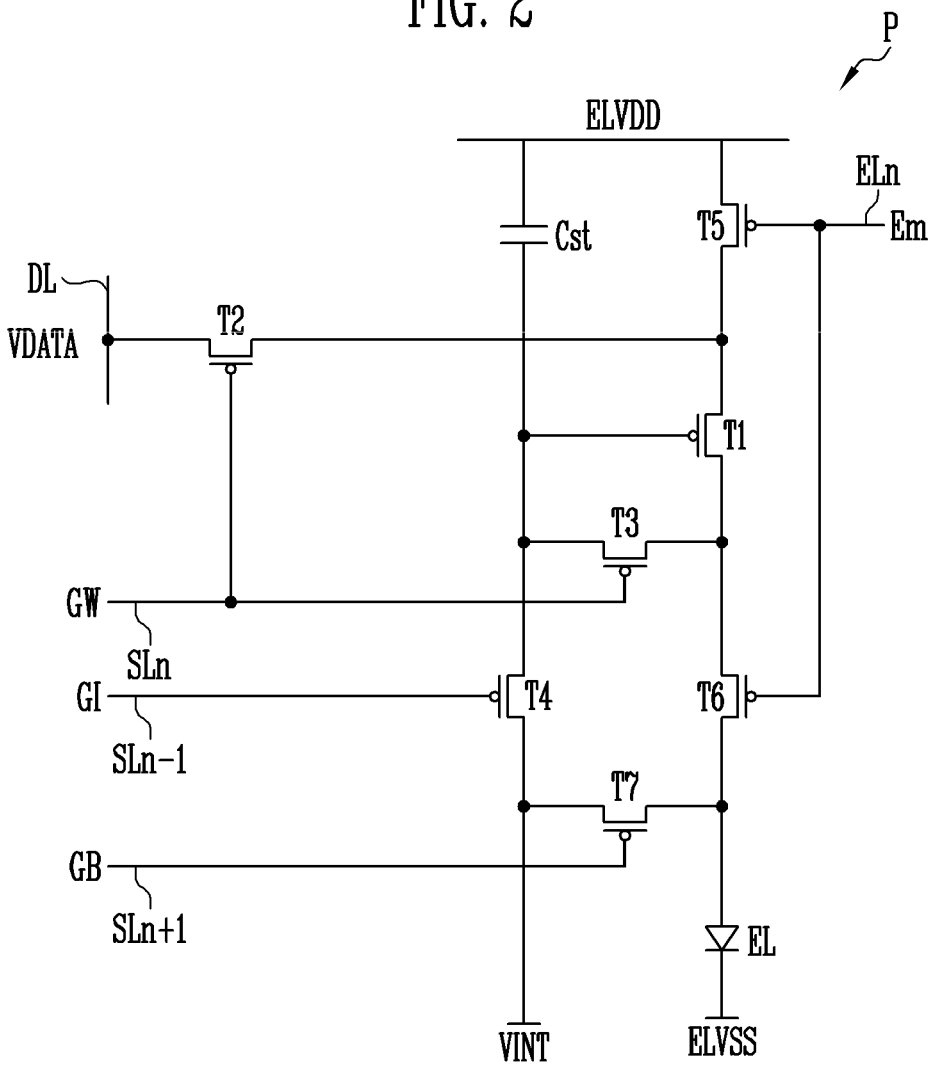
FIG. 2 is a diagram illustrating a pixel shown in FIG. 1 according to some example embodiments.

FIG. 2 is a diagram illustrating further details of the pixel P shown in FIG. 1 according to some example embodiments.

Referring to FIG. 2, the pixel P may include first to seventh transistors T1 to T7, a storage capacitor Cst, and an organic light emitting diode EL.

The first transistor (driving transistor) T1 may include a gate electrode coupled to a first electrode of the storage capacitor Cst, a first electrode electrically coupled to the high-potential driving power voltage ELVDD via the fifth transistor T5, and a second electrode electrically coupled to an anode of the organic light emitting diode EL via the sixth transistor T6. The first transistor T1 may receive a data signal VDATA according to a switching operation of the second transistor T2 to supply a driving current to the organic light emitting diode EL.

The second transistor (switching transistor) T2 may include a gate electrode coupled to a scan line SLn, a first electrode coupled to a data line DL, and a second electrode coupled to the first electrode of the first transistor T1. The second transistor T2 may be turned on according to a scan signal GW transferred through the scan line SLn, to transfer the data signal VDATA to the first electrode of the first transistor T1.

The third transistor (compensation transistor) T3 may include a gate electrode coupled to the scan line SLn, a first electrode coupled to the second electrode of the first transistor T1, and a second electrode commonly coupled to the first electrode of the storage capacitor Cst, a second electrode of the fourth transistor T4, and the gate electrode of the first transistor T1. The third transistor T3 may be turned on according to the scan signal GW, to allow the first transistor T1 to be diode-coupled and to compensate for a threshold voltage of the first transistor T1.

The fourth transistor (initialization transistor) T4 may include a gate electrode connected to an initialization line SLn−1 (e.g., a previous scan line), a first electrode electrically coupled to the initialization power voltage VINT, and the second electrode commonly coupled to the second electrode of the third transistor T3 and the gate electrode of the first transistor T1. The fourth transistor T4 may be turned on according to an initialization signal GI, to perform an initialization operation of initializing a gate voltage of the first transistor T1 by transferring the initialization power voltage VINT to the gate electrode of the first transistor T1. The initialization voltage VINT may be a global voltage provided to the entire display panel. In addition, the initialization signal GI may correspond to a previous scan signal.

The fifth transistor (operation control transistor) T5 may include a gate electrode coupled to an emission control line ELn, a first electrode electrically coupled to the high-potential driving power voltage ELVDD, and a second electrode coupled to the second electrode of the first transistor T1. The fifth transistor T5 may control connection between the first electrode of the first transistor T1 and the high-potential driving power voltage ELVDD, based on an emission control signal Em.

The sixth transistor (emission control transistor) T6 may include a gate electrode coupled to the emission control line ELn, a first electrode commonly coupled to the second electrode of the first transistor T1 and the first electrode of the third transistor T3, and a second electrode electrically coupled to the anode of the organic light emitting diode EL. The fifth transistor T5 and the sixth transistor T6 may be simultaneously turned on according to the emission control signal Em, to enable an emission current to flow through the organic light emitting diode EL.

The seventh transistor (bypass transistor) T7 may include a gate electrode coupled to a bypass control line SLn+1 (i.e., a next scan line), a first electrode commonly coupled to the second electrode of the sixth transistor T6 and the anode of the organic light emitting diode EL, and a second electrode electrically coupled to the initialization power voltage VINT. The seventh transistor T7 may be turned on according to a bypass signal GB provided from the bypass control line SLn+1, to apply the initialization voltage VINT to the anode of the organic light emitting diode EL. Therefore, the organic light emitting diode EL may be initialized. The seventh transistor T7 is an element required to clearly display a black image or black luminance. The bypass signal GB may correspond to a next scan signal of the scan signal GW.

The storage capacitor Cst may be coupled between the gate electrode of the first transistor T1 and the high-potential driving power voltage ELVDD.

The anode of the organic light emitting diode EL may be commonly coupled to the second electrode of the sixth transistor T6 and the first electrode of the seventh transistor T7, and a cathode of the organic light emitting diode EL may be electrically coupled to the low-potential driving power voltage ELVSS. The low-potential driving power voltage ELVSS may be a voltage determined by the luminance control unit 200, corresponding to an ambient illumination intensity of the display device and a target brightness. The low-potential driving power voltage ELVSS may be a global voltage provided to the entire display panel.

Meanwhile, although a case where the first to seventh transistors T1 to T7 are implemented with a p-type transistor is illustrated in FIG. 2, the present disclosure is not limited thereto. That is, according to some example embodiments of the present disclosure, at least some or all of the first to seventh transistors T1 to T7 may be implemented with an n-type transistor. Therefore, a structure and driving method of the pixel P may be variously modified corresponding to a change in transistor type.

Figure 3:
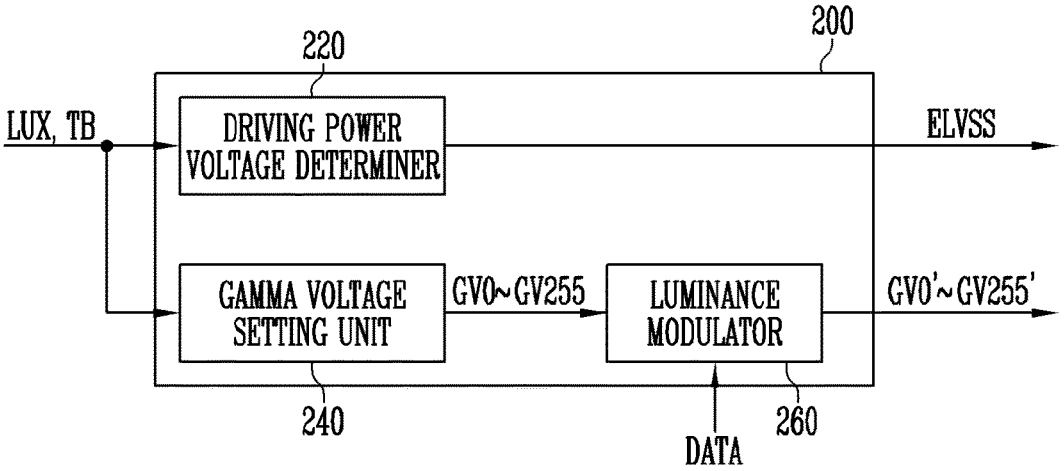
FIG. 3 is a block diagram illustrating an example of a luminance control unit shown in FIG. 1.
Figure 4:
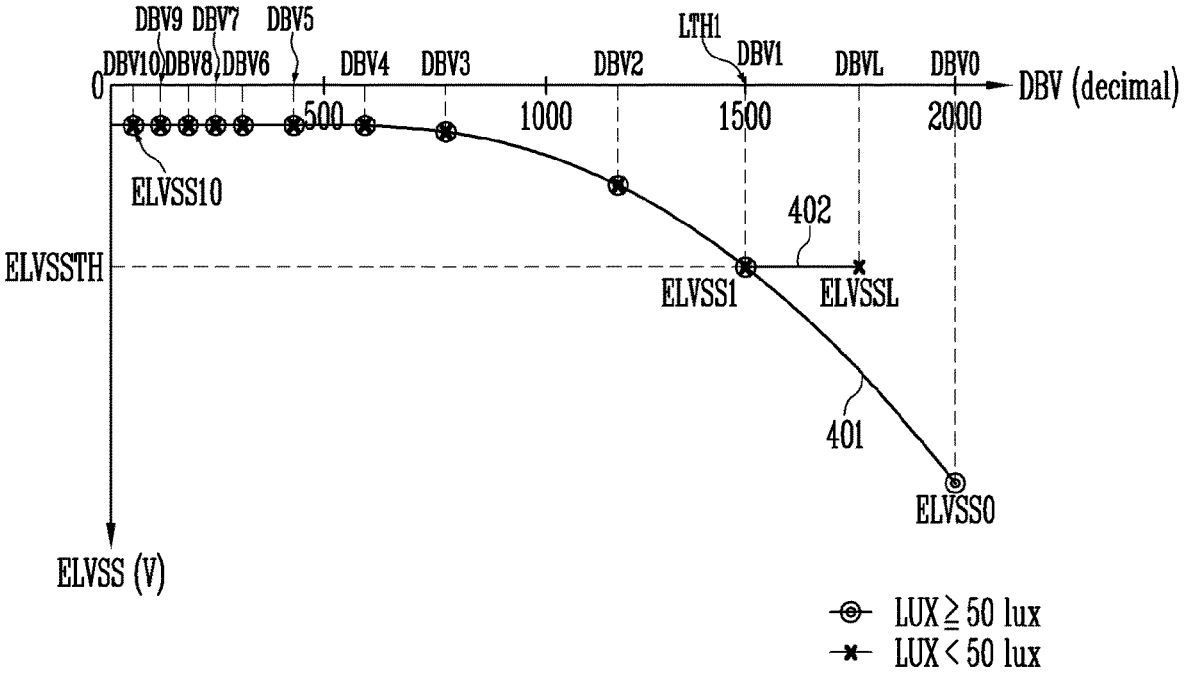
FIG. 4 is a diagram illustrating an example of low-potential driving power voltages corresponding to reference brightnesses.
Figure 5:
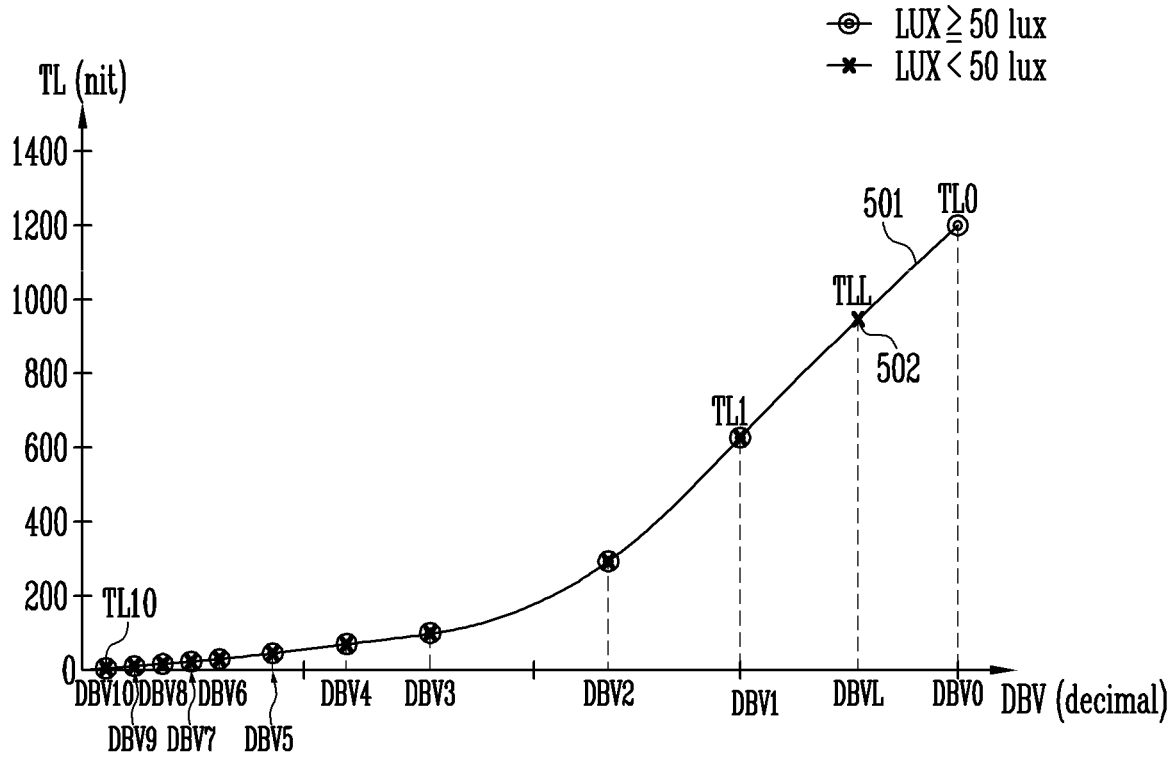
FIG. 5 is a diagram illustrating an example of target luminances corresponding to reference brightnesses.
Figure 6:
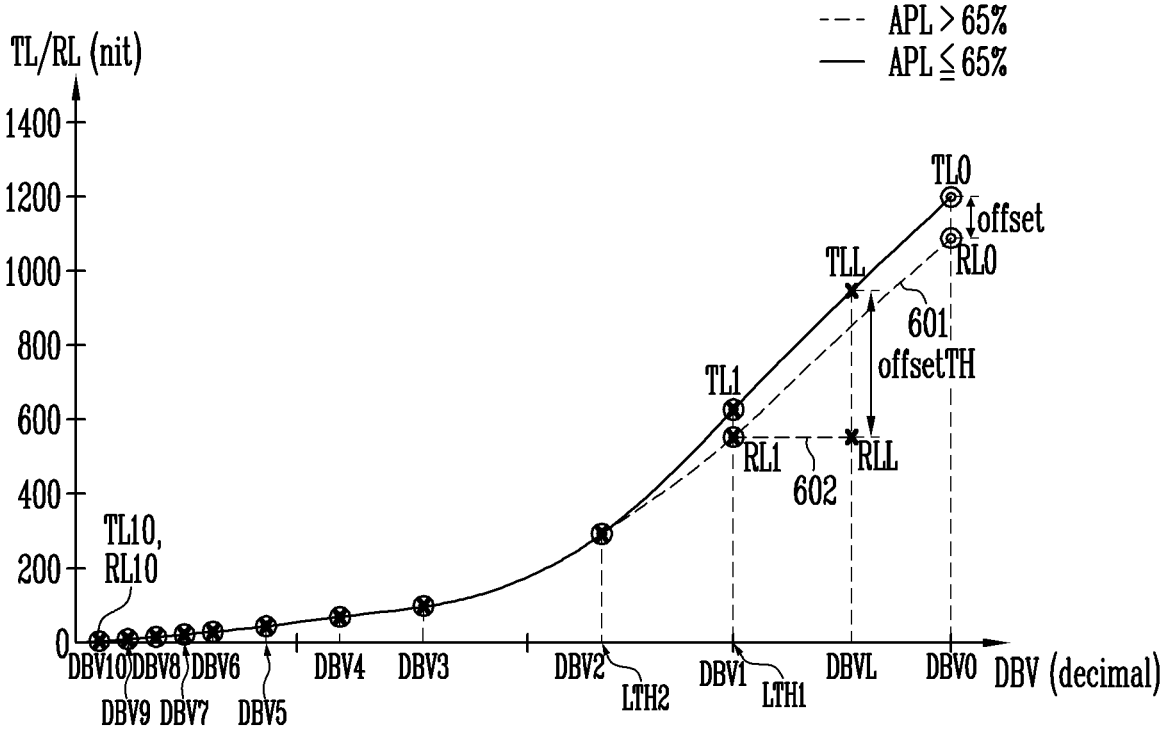
FIG. 6 is a diagram illustrating an example of target luminances corresponding to reference brightnesses when luminance modulation is performed.

FIG. 3 is a block diagram illustrating an example of the luminance control unit shown in FIG. 1. FIG. 4 is a diagram illustrating an example of low-potential driving power voltages corresponding to reference brightnesses. FIG. 5 is a diagram illustrating an example of target luminances corresponding to reference brightnesses. FIG. 6 is a diagram illustrating an example of target luminances corresponding to reference brightnesses when luminance modulation is performed.

Referring to FIG. 3, the luminance control unit 200 may include a driving power voltage determiner 220, a gamma voltage setting unit 240, and a luminance modulator 260.

The luminance control unit 200 may determine a low-potential driving power voltage ELVSS and gamma voltages GV0 to GV255, based on an ambient illumination intensity LUX and a target brightness TB. Also, the luminance control unit 200 may perform correction on the determined gamma voltages GV0 to GV255, based on an APL of input image data DATA.

The driving power voltage determiner 220 may include low-potential driving power voltages ELVSS0 to ELVSS10 respectively corresponding to reference brightnesses DBV0 to DBV10, with respect to when the ambient illumination intensity LUX is greater than or equal to an illumination intensity threshold value. Also, the driving power voltage determiner 220 may include low-potential driving power voltages ELVSSL to ELVSS10 respectively corresponding to reference brightnesses DBVL to DBV10, with respect to when the ambient illumination intensity LUX is smaller than the illumination intensity threshold value. The illumination intensity threshold value may be, for example, 50 lux.

A zeroth reference brightness DBV0 may correspond to the brightest brightness, and a tenth reference brightness DBV10 may correspond to the darkest brightness. For example, the zeroth reference brightness is the maximum brightness of the display device, and may correspond to about 200 lux. The tenth reference brightness may correspond to about 100 lux.

An Lth reference brightness DBVL may have a value between the zeroth reference brightness DBV0 and a first reference brightness DBV1, but the present disclosure is not limited thereto. The Lth reference brightness DBVL may be the maximum value of a reference brightness allowed in a threshold low-potential driving power voltage ELVSSTH which will be described later.

According to some example embodiments, when a maximum reference brightness is 2000 lux, the Lth reference brightness DBVL may be 1880 lux, and the first reference brightness DBV1 may be 1500 lux. When the Lth reference brightness DBVL is set, that the target brightness TB is set to a value greater than the Lth reference brightness DBVL may be limited by a user, an application or the like.

Referring to a first line 401 shown in FIG. 4, when the ambient illumination intensity LUX is greater than or equal to the illumination intensity threshold value, zeroth to tenth low-potential driving power voltages ELVSS0 to ELVSS10 may be set to smaller values with respect to a brighter reference brightness. For example, the zeroth low-potential driving power voltage ELVSS0 among the zeroth to tenth low-potential driving power voltages ELVSS0 to ELVSS10 may correspond to the lowest voltage, and the tenth low-potential driving power voltage ELVSS10 among the zeroth to tenth low-potential driving power voltages ELVSS0 to ELVSS10 may correspond to the highest voltage.

Referring to a second line 402 shown in FIG. 4, when the ambient illumination intensity LUX is smaller than the illumination intensity threshold value, Lth to tenth low-potential driving power voltages ELVSSL to ELVSS10 may be set to smaller values with respect to a brighter brightness from the tenth reference brightness DBV10 to a first threshold brightness LTH1, and be set to the same value, i.e., the threshold low-potential driving power voltage ELVSSTH from the first threshold brightness LTH1 to the Lth reference brightness DBVL.

According to some example embodiments, the first threshold brightness LTH1 may be a minimum value of reference brightnesses with which an abnormal output such as a spot is not viewed on the display panel 100 even when the display panel 100 is driven by the same low-potential driving power voltage ELVSS. The same low-potential driving power voltage ELVSS may be the threshold low-potential driving power voltage ELVSSTH which will be described later. According to some example embodiments, the first threshold brightness LTH1 may be the first reference brightness DBV1, but the present disclosure is not limited thereto.

For example, the first threshold brightness LTH1 may be the first reference brightness DBV1, and the threshold low-potential driving power voltage ELVSSTH may be the first low-potential driving power voltage ELVSS1. Therefore, low-potential driving power voltages ELVSS with respect to the Lth reference brightness DBVL and the first reference brightness DBV1 may be equally set to the threshold low-potential driving power voltage ELVSSTH.

According to some example embodiments, as shown in FIG. 4, the first to tenth low-potential driving power voltages ELVSS1 to ELVSS10 may be equally set with respect to when the ambient illumination intensity LUX is greater than or equal to the illumination luminance threshold value and when the ambient illumination intensity LUX is smaller than the illumination luminance threshold value, but the present disclosure is not limited thereto.

The driving power voltage determiner 220 may receive an ambient illumination intensity and a target brightness TB. The driving power voltage determiner 220 may select, as a low-potential driving power voltage ELVSS, one of the zeroth to tenth low-potential driving power voltages ELVSS0 to ELVSS10 or the Lth to tenth low-potential driving power voltages ELVSSL to ELVSS10, based on the ambient illumination intensity LUX and the target brightness TB.

For example, when the target brightness TB corresponds to a kth reference brightness, the driving power voltage determiner 220 may determine a kth low-potential driving power voltage as the low-potential driving power voltage. When the target brightness TB corresponds to a reference brightness between the kth reference brightness and a (k−1) th reference brightness, the driving power voltage determiner 220 may determine a low-potential driving power voltage ELVSS by interpolating the kth low-potential driving power voltage and a (k−1)th low-potential driving power voltage.

The driving power voltage determiner 220 may provide the determined low-potential driving power voltage ELVSS to the power provider 500. The low-potential driving power voltage ELVSS provided to the power provider 500 may be supplied to the display panel 100.

The gamma voltage setting unit 240 may include zeroth to tenth target luminances TL0 to TL10 respectively corresponding to the zeroth to tenth reference brightnesses DBV0 to DBV10, with respect to when the ambient illumination intensity LUX is greater than or equal to the illumination intensity threshold value. Also, the gamma voltage setting unit 240 may include Lth to tenth target luminances TLL to TL10 respectively corresponding to the Lth to tenth reference brightnesses DBVL to DBV10, with respect to when the ambient illumination intensity LUX is smaller than the illumination intensity threshold value.

The illumination intensity threshold value may be, for example, 50 lux. A target luminance TL is the maximum value of a luminance allowed in a corresponding reference brightness. For example, the target luminance TL may be a luminance in a white grayscale.

Referring to a first line 501 shown in FIG. 5, when the ambient illumination intensity LUX is greater than or equal to the illumination intensity threshold value, the zeroth to tenth target luminances TL0 to TL10 may be set to greater values with respect to a brighter reference brightness. For example, the zeroth target luminance TL0 among the zeroth to tenth target luminances TL0 to TL10 may correspond to the highest luminance, and the tenth target luminance TL10 among the zeroth to tenth target luminances TL0 to TL10 may correspond to the lowest luminance. For example, the zeroth target luminance TL0 may be 1200 nits, and the tenth target luminance TL10 may be 2 nits.

Referring to a second line 502 shown in FIG. 5, when the ambient illumination intensity LUX is smaller than the illumination intensity threshold value, the Lth to tenth target luminances TLL to TL10 may be set to greater values with respect to a brighter reference brightness. For example, the Lth target luminance TLL among the Lth to tenth target luminances TLL to TL10 may correspond to the highest luminance, and the tenth target luminance TL10 among the Lth to tenth target luminances TLL to TL10 may correspond to the lowest luminance. For example, the Lth target luminance TLL may be 100 nits, and the tenth target luminance TL10 may be 2 nits.

According to some example embodiments of the present disclosure, because the Lth reference brightness DBVL has a brightness darker than the zeroth reference brightness DBV0, the Lth target luminance TLL may be set to a value smaller than the zeroth target luminance TL0. According to some example embodiments, when the Lth reference brightness DBVL has a value between the zeroth reference brightness DBV0 and the first reference brightness DBV1, the Lth target luminance TLL may be set to a value between the zeroth target luminance TL0 to the first target luminance TL1. For example, when the zeroth target luminance TL0 is 2000 nits and the first target luminance TL1 is 650 nits, the Lth target luminance TLL may be set to 1000 nits.

According to some example embodiments, as shown in FIG. 5, the first to tenth target luminances TL1 to TL10 may be equally set with respect to when the ambient illumination intensity LUX is greater than or equal to the illumination intensity threshold value and when the ambient illumination intensity LUX is smaller than the illumination intensity threshold value, but embodiments of the present disclosure are not limited thereto.

The gamma voltage setting unit 240 may determine a target luminance TL, based to the ambient illumination intensity LUX and the target brightness TB. When a target luminance TL is determined, the gamma voltage setting unit 240 may set gamma voltages GV0 to GV255 for implementing the corresponding target luminance TL.

For example, when the target brightness TB corresponds to the kth reference brightness, the gamma voltage setting unit 240 may set gamma voltages GV0 to GV255 to implement a kth target luminance. When the target brightness TB corresponds to a reference brightness between the kth reference brightness and the (k−1)th reference brightness, the gamma voltage setting unit 240 may determine a target luminance TL by interpolating the kth target luminance and a (k−1)th target luminance.

The luminance modulator 260 may include may include correction luminances RL0 to RL10 and RLL to LR10 respectively corresponding to the reference brightnesses DBV0 to DBV10 and DBVL to DBV10, when the APL of the input image data DATA is greater than an APL threshold value. The APL threshold value may be set as a value that is 65% of the maximum APL of the input image data DATA.

According to some example embodiments of the present disclosure, the correction luminances RL0 to RL10 and RLL to LR10 may be differently set depending on the ambient illumination intensity LUX. For example, zeroth to tenth correction luminances TL0 to TL10 may be set with respect to when the ambient illumination intensity LUX is greater than or equal to the illumination intensity threshold value. In addition, Lth to tenth correction luminances RLL to RL10 may be set with respect to when the ambient illumination intensity LUX is smaller than the illumination intensity threshold value.

Referring to FIG. 6, the correction luminances RL0 to RL10 and RLL to LR10 are values determined by applying a correction offset offset to the above-described target luminances TL0 to TL10 and TLL to TL10, and may be set smaller than the target luminances TL0 to TL10 and TLL to TL10 in a reference brightness brighter than a second threshold brightness LTH2. The second threshold brightness LTH2 may be, for example, a second reference brightness DBV2, but the present disclosure is not limited thereto. Also, the second threshold brightness LTH2 may be set to a value smaller than the above-described first threshold brightness LTH1, but the present disclosure is not limited thereto.

Referring to a first line 601 shown in FIG. 6, when the ambient illumination intensity LUX is larger than or equal to the illumination intensity threshold value, the correction offset offset may increase from the second threshold brightness LTH2 to the zeroth reference brightness DBV0. The correction offset offset may be differently determined with respect to reference brightnesses DBV0 and DBV1 brighter than the second threshold brightness LTH2.

Referring to a second line 602 shown in FIG. 6, when the ambient illumination intensity LUX is smaller than the illumination intensity threshold value, the correction offset offset may increase from the second threshold brightness LTH2 to the first threshold brightness LTH1. Also, the correction offset offset may be set to the same value, i.e., a threshold correction offset offsetTH from the first threshold brightness LTH1 to the Lth reference brightness DBVL. The threshold correction offset offsetTH may be set to a maximum target luminance, e.g., a value that is 35% of the Lth target luminance TLL, but the present disclosure is not limited thereto.

When the APL of the input image data DATA is greater than the APL threshold value, the luminance modulator 260 may correct the gamma voltages GV0 to GV255 set by the gamma voltage setting unit 240, based on the correction luminances RL0 to RL10 and RLL to RL10. That is, the luminance modulator 260 may determine a correction luminance RL, based on the ambient illumination intensity LUX and the target brightness TB, and correct the gamma voltages GV0 to GV255 such that the determined correction luminance RL can be implemented.

When the target luminance TL is corrected to the correction luminance RL, a gamma voltage (e.g., GV255) with respect to a high grayscale may be decreased, and all the gamma voltages may be decreased corresponding to the decreased high-grayscale gamma voltage. When all the gamma voltages GV0 to GV255 are decreased, power consumption of the display panel 100 driven by corrected gamma voltages GV0' to GV255' can be reduced.

Meanwhile, according to some example embodiments as described above, a case where the transistors T1 to T7 in the pixel P are implemented with a p-type transistor is described as shown in FIG. 2. According to some example embodiments, when the transistors T1 to T7 in the pixel P are implemented with an n-type transistor, a gamma voltage (e.g., GV0) with respect to a low grayscale may decrease. Therefore, all the gamma voltages may be decreased corresponding to the decreased low-grayscale gamma voltage. Such a modification may be identically applied to the following embodiments.

The luminance modulator 260 may output the corrected gamma voltages GV0' to GV255' to the data driver 460.

Meanwhile, when the APL of the input image data DATA is smaller than or equal to the APL threshold value, the target luminance TL may not be corrected by the luminance modulator 260. Therefore, the luminance modulator 260 does not correct the gamma voltages GV0 to GV255 set by the gamma voltage setting unit 240 but may output the gamma voltages GV0 to GV255 as they are.

As described above, the luminance controller 200 can control the low-potential driving power voltage ELVSS and the gamma voltage according to the ambient illumination intensity LUX and the target brightness TB, which are commonly applied to the display panel. For example, the luminance control unit 260 limits the low-potential driving power voltage ELVSS to the threshold low-potential driving power voltage ELVSSTH in a low luminance environment, and limits the reference brightness DBV to a value (e.g., the Lth reference brightness DBVL) smaller than the maximum reference brightness, so that a weak bright spot can be prevented from being viewed or perceived in the display panel 100. Also, the luminance control unit 260 performs luminance correction according to the APL of the input image data DATA, so that the power consumption of the display panel 100 can be reduced.

FIG. 7 is a diagram illustrating an example in which reference brightnesses, target luminances, and low-potential driving power voltages are set in a high illumination intensity environment. FIG. 8 is a diagram illustrating an example in which reference brightnesses, target luminances, and low-potential driving power voltages are set in a low illumination intensity environment.

Referring to FIGS. 7 and 8, the luminance controller 200 may include a plurality of low-potential driving power voltages and a plurality of target luminances, which correspond to a plurality of reference brightnesses DBV0 to DBV10 and DBVL to DVB10.

The low-potential driving power voltages ELVSS and the target luminances TL of the display device may be divided according to the plurality of reference brightnesses DBV0 to DBV10 and DBVL to DVB10. A reference brightness DBV in a high illumination intensity environment may be divided into zeroth to tenth reference brightnesses DBV0 to DBV10. The zeroth reference brightness DBV0 may be the highest brightness, and the tenth reference brightness DBV10 may be the lowest brightness. A reference brightness DBV in a low illumination intensity environment may be divided into Lth to tenth reference brightnesses DBVL to DBV10. The Lth reference brightness DBVL may be a brightness darker than the zeroth reference brightness DBV0.

In the high illumination intensity environment, the low-potential driving power voltages ELVSS may be set to smaller values with respect to a brighter reference brightness. For example, a low-potential driving power voltage ELVSS corresponding to the zeroth reference brightness DBV0 may be set to −5V, and a low-potential driving power voltage ELVSS corresponding to the tenth reference brightness DBV10 may be set to −1.5V.

In the low illumination intensity environment, a low-potential driving power voltage ELVSS corresponding to the Lth reference brightness DBVL may be set greater than that ELVSS corresponding to the zeroth reference brightness DBV0. For example, the low-potential driving power voltage ELVSS corresponding to the Lth reference brightness DBVL may be set to the same value, i.e., −5V as that corresponding to the first reference brightness DBV1.

In the high illumination intensity environment, a target luminance TL may be set to a smaller value with respect to a brighter reference brightness. For example, a target luminance TL corresponding to the zeroth reference brightness DBV0 may be set to 1200 nits, and a target luminance TL corresponding to the tenth reference brightness DBV10 may be set to 2 nits. However, this is merely illustrative, and the scope of the present disclosure is not limited to the above-described reference numerals.

In the low illumination intensity environment, a target luminance TL corresponding to the Lth reference brightness DBVL may be set smaller than that TL corresponding to the zeroth reference brightness DBV0. For example, when the target luminance TL corresponding to the zeroth reference brightness DBV0 is set to 2000 nits, the target luminance TL corresponding to the Lth reference brightness DBVL may be set to 1000 nits.

According to some example embodiments, the luminance control unit 200 may further include a threshold correction offset offsetTH for luminance modulation of input image data DATA. The threshold correction offset offsetTH may be set with respect to a low illumination intensity, and be set with respect to the Lth reference brightness DBVL.

Figure 9:
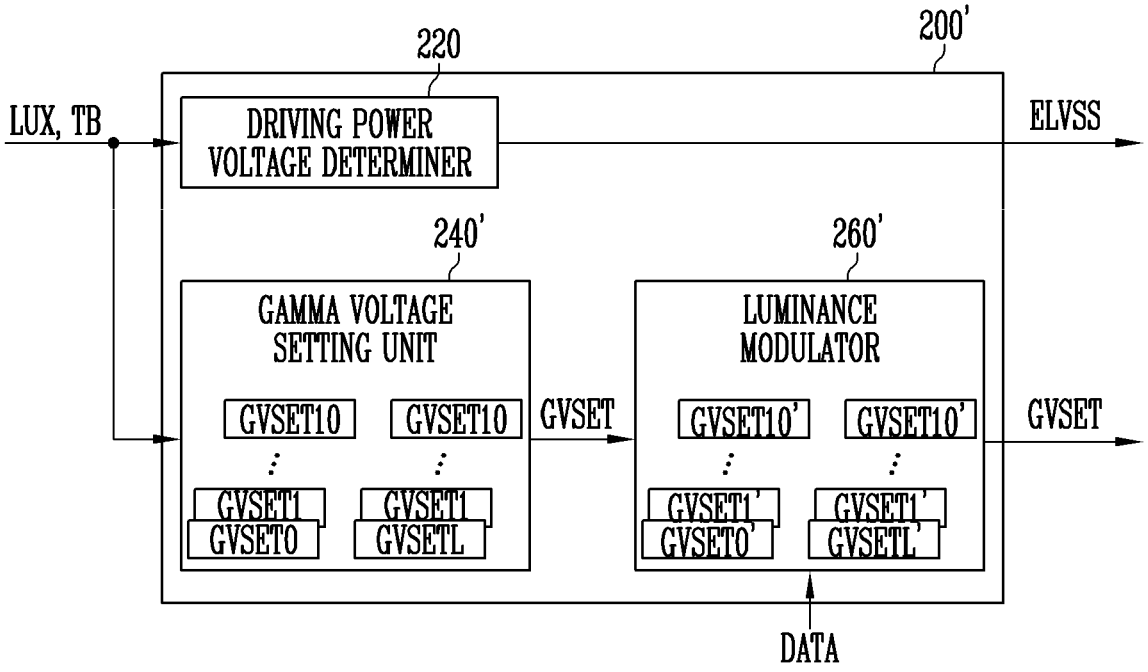
FIG. 9 is a block diagram illustrating an example of the luminance control unit shown in FIG. 1.

FIG. 9 is a block diagram illustrating an example of the luminance control unit (or luminance controller or luminance control circuit) shown in FIG. 1 according to some example embodiments.

Referring to FIG. 9, according to some example embodiments the luminance control unit 200' may include a driving power voltage determiner 220, a gamma voltage setting unit (or gamma voltage setter, or gamma voltage setting circuit) 240', and a luminance modulator 260'.

The driving power voltage determiner 220 may include low-potential driving power voltages ELVSS0 to ELVSS10 respectively corresponding to reference brightnesses DBV0 to DBV10, with respect to when an ambient illumination intensity LUX is greater than or equal to an illumination intensity threshold value. Also, the driving power voltage determiner 220 may include low-potential driving power voltages ELVSSL to ELVSS10 respectively corresponding to reference brightnesses DBVL to DBV10, with respect to when the ambient illumination intensity LUX is smaller than the illumination intensity threshold value. The illumination intensity threshold value may be, for example, 50 lux.

A zeroth reference brightness DBV0 may correspond to the brightest brightness, and a tenth reference brightness DBV10 may correspond to the darkest brightness. For example, the zeroth reference brightness is the maximum brightness of the display device, and may correspond to about 200 lux. The tenth reference brightness may correspond to about 100 lux.

An Lth reference brightness DBVL may have a value between the zeroth reference brightness DBV0 and a first reference brightness DBV1, but the present disclosure is not limited thereto. The Lth reference brightness DBVL may be the maximum value of a reference brightness allowed in a threshold low-potential driving power voltage ELVSSTH which will be described in more detail later.

According to some example embodiments, when a maximum reference brightness is 2000 lux, the Lth reference brightness DBVL may be 1880 lux, and the first reference brightness DBV1 may be 1500 lux. When the Lth reference brightness DBVL is set, that the target brightness TB is set to a value greater than the Lth reference brightness DBVL may be limited by a user, an application or the like.

According to some example embodiments, a first threshold brightness LTH1 may be a minimum value of reference brightnesses with which an abnormal output such as a spot is not viewed or perceived on the display panel 100 even when the display panel 100 is driven by the same low-potential driving power voltage ELVSS. The same low-potential driving power voltage ELVSS may be the threshold low-potential driving power voltage ELVSSTH which will be described later. According to some example embodiments, the first threshold brightness LTH1 may be the first reference brightness DBV1, but example embodiments according to the present disclosure re not limited thereto.

For example, the first threshold brightness LTH1 may be the first reference brightness DBV1, and the threshold low-potential driving power voltage ELVSSTH may be the first low-potential driving power voltage ELVSS1. Therefore, low-potential driving power voltages ELVSS with respect to the Lth reference brightness DBVL and the first reference brightness DBV1 may be equally set to the threshold low-potential driving power voltage ELVSSTH.

The driving power voltage determiner 220 may receive an ambient illumination intensity and a target brightness TB. The driving power voltage determiner 220 may select, as a low-potential driving power voltage ELVSS, one of the zeroth to tenth low-potential driving power voltages ELVSS0 to ELVSS10 or the Lth to tenth low-potential driving power voltages ELVSSL to ELVSS10, based on the ambient illumination intensity LUX and the target brightness TB.

For example, when the target brightness TB corresponds to a kth reference brightness, the driving power voltage determiner 220 may determine a kth low-potential driving power voltage as the low-potential driving power voltage. When the target brightness TB corresponds to a reference brightness between the kth reference brightness and a (k−1) th reference brightness, the driving power voltage determiner 220 may determine a low-potential driving power voltage ELVSS by interpolating the kth low-potential driving power voltage and a (k−1)th low-potential driving power voltage.

The driving power voltage determiner 220 may provide the determined low-potential driving power voltage ELVSS to the power provider 500. The low-potential driving power voltage ELVSS provided to the power provider 500 may be supplied to the display panel 100.

The gamma voltage setting unit 240' may include gamma voltage sets GVSET0 to GVSET10 respectively corresponding to the zeroth to tenth reference brightnesses DBV0 to DBV10, with respect to when the ambient illumination intensity LUX is greater than or equal to the illumination intensity threshold value. Also, the gamma voltage setting unit 240' may include gamma voltage sets GVSETL to GVSET10 respectively corresponding to the Lth to tenth reference brightnesses DBVL to DBV10, with respect to when the ambient illumination intensity LUX is smaller than the illumination intensity threshold value.

Each of the gamma voltage sets GVSET0 to GVSET10 and GVSETL to GVSET10 may include gamma voltages GV0 to GV255. Gamma voltages GV0 to GV255 included in an arbitrary gamma voltage set may be set to implement a target luminance of a reference brightness mapped to the corresponding gamma voltage set. The target luminance TL may be set to a greater value with respect to a brighter reference brightness, but example embodiments according to the present disclosure are not limited thereto.

The gamma voltage setting unit 240' may select any one of the gamma voltage sets GVSET0 to GVSET10 and GVSETL to GVSET10, based on the ambient illumination intensity LUX and the target brightness TB. For example, when the target brightness TB corresponds to the kth reference brightness, the gamma voltage setting unit 240' may select a gamma voltage set corresponding to a kth target luminance.

According to some example embodiments, when the target brightness TB corresponds to a reference brightness between the kth reference brightness and the (k−1)th reference brightness, the gamma voltage setting unit 240' may generate a gamma voltage set by interpolating gamma voltages GV0 to GV255 of gamma voltage sets corresponding to a kth reference luminance and gamma voltages GV0 to GV255 of gamma voltage sets corresponding to a (k−1)th reference luminance.

The gamma voltage setting unit 240' may transfer the selected gamma voltage set to the luminance modulator 260'.

The luminance modulator 260' may correct the gamma voltages GV0 to GV255 of the gamma voltage set transferred from the gamma voltage setting unit 240', when an APL of input image data DATA is greater than an APL threshold value. For example, the APL threshold value may be set to a value that is 65% of the maximum APL of the input image data DATA.

The luminance modulator 260' may include corrected gamma voltage sets GVSET0' to GVSET10' and GVSETL' to GVSET10' with respect to the gamma voltage sets GVSET0 to GVSET10 and GVSETL to GVSET10, when the APL of the input image data DATA is greater than the APL threshold value. Therefore, the luminance modulator 260 may select a corrected gamma voltage set, corresponding to the gamma voltage set transferred from the gamma voltage setting unit 240'.

The luminance modulator 260' may include correction values with respect to the gamma voltages GV0 to GV255 included in the voltage sets GVSET0 to GVSET10 and GVSETL to GVSET10. Therefore, the luminance modulator 260' may correct the gamma voltage set transferred from the gamma voltage setting unit 240', using corresponding correction values.

According to some example embodiments, when the gamma voltage setting unit 240' transfers a gamma voltage set generated through interpolation, the luminance modulator 260' may generate a corrected gamma voltage set by interpolating the pre-stored corrected gamma voltage sets GVSET0' to GVSET10' and GVSETL' to GVSET10' or the pre-stored correction values.

The corrected gamma voltage sets GVSET0' to GVSET10' and GVSETL' to GVSET10' may include corrected gamma voltages GV0' to GV255' for implementing a predetermined correction luminance RL, corresponding to the ambient illumination intensity LUX and the reference brightnesses DBV0 to DBV10 and DBVL to DBV10. The correction luminance RL may be a luminance obtained by correcting target luminances TL corresponding to the reference brightnesses DBV0 to DBV10 and DBVL to DBV10, based on a correction offset offset.

The luminance modulator 260' may output the selected corrected gamma voltage set to the data driver 460.

Meanwhile, when the APL of the input image data DATA is smaller than or equal to the APL threshold value, the gamma voltages GV0 to GV255 may not be corrected by the luminance modulator 260'. Therefore, the luminance modulator 260' does not correct the gamma voltage set transferred from the gamma voltage setting unit 240' but may output the gamma voltage set as it is.

The embodiments described with reference to FIGS. 3 to 8 may be identically or similarly applied to the embodiment shown in FIG. 9. That is, in the embodiment described with reference to FIG. 9, gamma voltages GV0 to GV255 of a gamma voltage set selected based on the ambient brightness LUX, the target brightness TB, and the APL of the input image data DATA may be preset and stored in each component of the luminance controller 200' in accordance with the embodiments described with reference to FIGS. 3 to 8.

Figure 10:
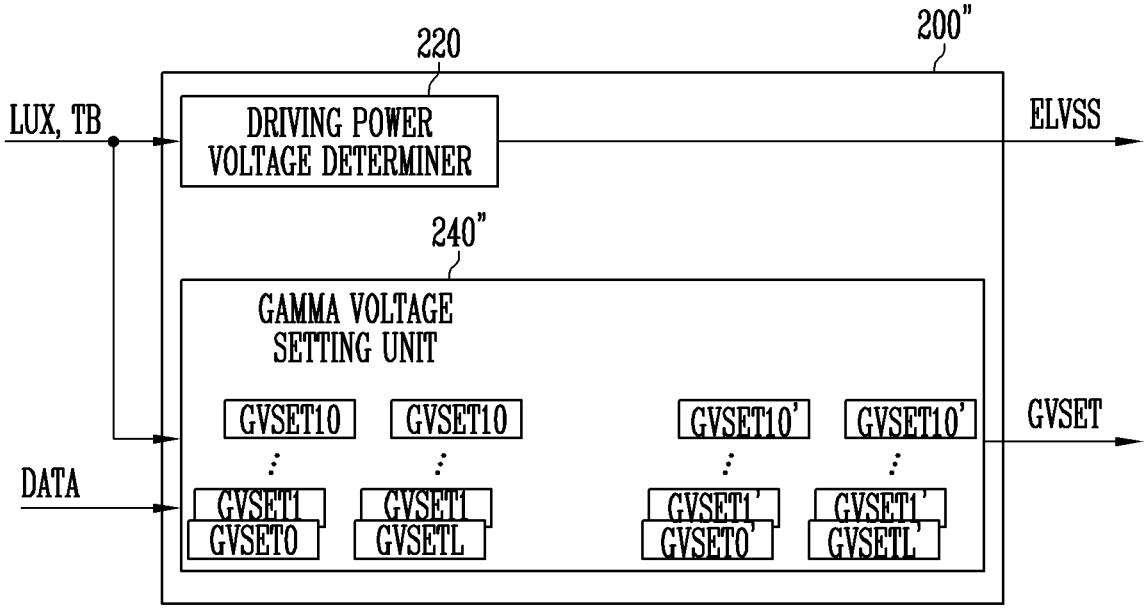
FIG. 10 is a block diagram illustrating an example of the luminance control unit shown in FIG. 1.

FIG. 10 is a block diagram illustrating an example of the luminance control unit (or luminance controller) shown in FIG. 1.

Referring to FIG. 10, the luminance control unit 200" may include a driving power voltage determiner 220 and a gamma voltage setting unit 240".

As compared with the embodiments shown in FIGS. 3 and 9, the luminance controller 200" in accordance with the embodiment shown in FIG. 10 may store gamma voltage sets GVSET0 to GVSET10 and GVSETL to GVSET10 corresponding to an ambient illumination intensity LUX when an APL of input image data DATA is smaller than or equal to a threshold value, and corrected gamma voltage sets GVSET0' to GVSET10' and GVSETL' to GVSET10' corresponding to the ambient illumination intensity LUX when the APL of the input image data DATA is greater than the threshold value. The gamma voltage sets GVSET0 to GVSET10 and GVSETL to GVSET10 and the corrected gamma voltage sets GVSET0' to GVSET10' and GVSETL' to GVSET10' may include gamma voltages GV0 to GV255 equal to those set in accordance with the embodiments described with reference to FIGS. 3 to 8.

Therefore, the gamma voltage setting unit 240" may select any one gamma voltage set among the gamma voltage sets GVSET0 to GVSET10 and GVSETL to GVSET10 and the corrected gamma voltage sets GVSET0' to GVSET10' and GVSETL' to GVSET10', based on the ambient illumination intensity LUX, the APL of the input image data DATA, and a target brightness TB.

According to some example embodiments, the gamma voltage setting unit 240" may require an additional storage space, but does not require a real-time calculation for determining a gamma voltage, so that faster data processing can be implemented.

In the luminance control unit and the display device including the same in accordance with some example embodiments of the present disclosure, a low-potential driving power voltage and a target brightness may be limited in a low illumination intensity environment. Accordingly, a weak bright spot can be prevented from being viewed or perceived in the display panel, and the image quality of the display device can be improved.

Further, in the luminance control unit and the display device including the same in accordance with some example embodiments of the present disclosure, luminance correction using an ACL function may be adaptively performed according to an ambient illumination intensity, so that the power consumption of the display panel can be reduced.

Aspects of some example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. A luminance control unit comprising:

a driving power voltage determiner configured to determine a driving power voltage to be provided to a display panel, the driving power voltage corresponding to a target brightness, based on a plurality of driving power voltages respectively corresponding to a plurality of reference brightnesses of the display panel; and a gamma voltage setting unit configured to determine a gamma voltage set corresponding to the target brightness, based on a plurality of gamma voltage sets respectively corresponding to the plurality of reference brightnesses, and to set gamma voltages for implementing a target luminance corresponding to the gamma voltage set, wherein the driving power voltage and the gamma voltages are differently set with respect to a same reference brightness according to an ambient illumination intensity of the display panel.

2. The luminance control unit of claim 1, wherein, when the ambient illumination intensity is less than an illumination intensity threshold value, a maximum value of the reference brightnesses is set smaller than a maximum reference brightness of the display panel.

3. The luminance control unit of claim 2, wherein the driving power voltage determiner is configured to equally set the driving power voltage as a threshold driving power voltage, corresponding to reference brightnesses greater than a first threshold brightness, in response to the ambient illumination intensity being less than the illumination intensity threshold value.

4. The luminance control unit of claim 3, wherein the first threshold brightness is a minimum value of reference brightnesses with which an abnormal output is not viewed on the display panel when the display panel is driven by the threshold driving power voltage.

5. The luminance control unit of claim 3, further comprising a luminance modulator configured to correct the gamma voltages in response to an Average Pixel Level (APL) of input image data being greater than or equal to an APL threshold value.

6. The luminance control unit of claim 5, wherein the luminance modulator is configured to determine a correction luminance with respect to the target luminance, based on the target brightness, and to correct the gamma voltages to implement the correction luminance.

7. The luminance control unit of claim 6, wherein the luminance modulator is configured to equally set the correction luminance, corresponding to reference brightnesses greater than the first threshold brightness, in response to the ambient illumination intensity being less than the illumination intensity threshold value.

8. The luminance control unit of claim 7, wherein the luminance modulator is configured to set the correction luminance such that a difference between the correction luminance and the target luminance with respect to the maximum value of the reference brightnesses corresponds to a threshold correction offset, in response to the ambient illumination intensity being less than the illumination intensity threshold value.

9. A luminance control unit comprising:

a driving power voltage determiner configured to determine a driving power voltage to be provided to a display panel, the driving power voltage corresponding to a target brightness, based on a plurality of driving power voltages respectively corresponding to a plurality of reference brightnesses of the display panel; and a gamma voltage setting unit configured to determine one of a gamma voltage set and a corrected gamma voltage set corresponding to the target brightness, based on a plurality of gamma voltage sets and a plurality of corrected gamma voltage sets respectively corresponding to the plurality of reference brightnesses, and to set gamma voltages for implementing a target luminance corresponding to the one of the gamma voltage set and the corrected gamma voltage set which is determined, wherein the driving power voltage and the gamma voltages are differently set with respect to a same reference brightness according to an ambient illumination intensity of the display panel.

10. The luminance control unit of claim 9, wherein, when the ambient illumination intensity is less than an illumination intensity threshold value, a maximum value of the reference brightnesses is set smaller than a maximum reference brightness of the display panel.

11. The luminance control unit of claim 10, wherein the driving power voltage determiner is configured to equally set the driving power voltage as a threshold driving power voltage, corresponding to reference brightnesses greater than a first threshold brightness, in response to the ambient illumination intensity being less than the illumination intensity threshold value.

12. The luminance control unit of claim 11, wherein the first threshold brightness is a minimum value of reference brightnesses with which an abnormal output is not viewed on the display panel when the display panel is driven by the threshold driving power voltage.

13. The luminance control unit of claim 11, wherein the gamma voltage setting unit is configured to correct the gamma voltages in response to an Average Pixel Level (APL) of input image data being greater than or equal to an APL threshold value.

14. The luminance control unit of claim 13, wherein the gamma voltage setting unit is configured to determine a correction luminance with respect to the target luminance, based on the target brightness, and to correct the gamma voltages to implement the correction luminance.

15. The luminance control unit of claim 14, wherein the gamma voltage setting unit is configured to equally set the correction luminance, corresponding to reference brightnesses greater than the first threshold brightness, in response to the ambient illumination intensity being less than the illumination intensity threshold value.

16. The luminance control unit of claim 15, wherein the gamma voltage setting unit is configured to set the correction luminance such that a difference between the correction luminance and the target luminance with respect to the maximum value of the reference brightnesses corresponds to a threshold correction offset, in response to the ambient illumination intensity being less than the illumination intensity threshold value.

* * * * *